US006775873B2

(12) United States Patent
Luoma

(10) Patent No.: US 6,775,873 B2
(45) Date of Patent: Aug. 17, 2004

(54) APPARATUS FOR REMOVING HAIR FROM A DRAIN

(76) Inventor: Eugene H. Luoma, 4423 Normanna Rd., Duluth, MN (US) 55803

( * ) Notice: Subject to any disclaimer, the term of this patent is extended or adjusted under 35 U.S.C. 154(b) by 0 days.

(21) Appl. No.: 09/734,249

(22) Filed: Dec. 11, 2000

(65) Prior Publication Data

US 2001/0011398 A1 Aug. 9, 2001

Related U.S. Application Data

(63) Continuation-in-part of application No. 29/118,498, filed on Feb. 9, 2000, now Pat. No. Des. 435,944.

(51) Int. Cl.[7] ..... B08B 9/27

(52) U.S. Cl. ..... 15/104.33; 15/104.05; 15/104.001; 15/104.31

(58) Field of Search ..... 15/104.001, 104.16, 15/104.05, 104.31, 104.33

(56) References Cited

U.S. PATENT DOCUMENTS

| | | | | |
|---|---|---|---|---|
| 566,570 | A | * | 8/1896 | Frick |
| 834,135 | A | | 10/1906 | Hymes |
| 986,268 | A | * | 3/1911 | Colina |
| 1,261,444 | A | * | 4/1918 | Schied |
| D59,382 | S | | 10/1921 | Shirley |
| 1,559,900 | A | * | 11/1925 | McCarthy |
| 1,588,737 | A | * | 6/1926 | Hurd |
| 1,608,347 | A | | 11/1926 | Thompson |
| 1,844,433 | A | * | 2/1932 | Markowitz |
| 1,886,676 | A | * | 11/1932 | Heuacker |
| 1,979,932 | A | | 11/1934 | Beckett |
| 2,096,162 | A | * | 10/1937 | Daley |
| 2,207,180 | A | | 7/1940 | Smith |
| 2,429,581 | A | * | 10/1947 | Maitlen |
| 2,479,224 | A | * | 8/1949 | Flinn |
| 2,529,952 | A | * | 11/1950 | Leunis |
| 3,360,818 | A | * | 1/1968 | Edwards |
| D237,994 | S | | 12/1975 | Davis |
| D247,590 | S | | 3/1978 | Atherton |
| 4,669,635 | A | * | 6/1987 | Brookhart |
| 4,889,106 | A | * | 12/1989 | Watanabe |
| 5,276,934 | A | * | 1/1994 | Brzoska |
| 5,769,960 | A | * | 6/1998 | Nirmel |
| 5,836,032 | A | | 11/1998 | Hondo |

FOREIGN PATENT DOCUMENTS

DE 9415962 U 12/1994

OTHER PUBLICATIONS

Miles Kimball Holiday Preview Catalog, Nov., 1999, p. 39.
The Family Handyman, Feb. 2000, p. 102.

* cited by examiner

*Primary Examiner*—Randall E. Chin
(74) *Attorney, Agent, or Firm*—Briggs & Morgan, P.A.

(57) ABSTRACT

An apparatus for removing hair from a drain consists of an elongate, flexible strip with an attached handle. A number of barbed portions are dispersed along the length of the flexible strip, with the barbed portions alternating along the two sides of the strip. The barbed portions are oriented at an acute angle to the longitudinal axis of the strip, with the vertex of the angle pointing away from the handle. The barbed portions serve to grip hair in the drain, the hair being removed when the device is removed from the drain.

12 Claims, 2 Drawing Sheets

APPARATUS FOR REMOVING HAIR FROM A DRAIN

This is a continuation-in-part of Design patent application, Ser. No. 29/118,498 filed on Feb. 9, 2000 now U.S. Pat. No. D435,944.

BACKGROUND OF THE INVENTION

The present invention relates to an apparatus for removing hair from a drain, and in particular to a simple apparatus that is inexpensive to manufacture.

Various devices for removing accumulated human hair from sink, bathtub and shower drains are known. For example, U.S. Pat. No. 5,836,032 (Hondo) discloses an apparatus consisting of an elongate shaft with a plurality of hook members for picking up hair located at the proximal end of the shaft and a handle at the distal end of the shaft.

However, there are a number of disadvantages with the Hondo device. First, the hook members are only located at the far end of the shaft, that is, the end that is inserted into the drain first. The limited number of hook members may result in the hook members being overwhelmed by a large amount of hair, with the result that much hair may remain in the drain. This would necessitate removing the shaft from the drain, removing the accumulated hair from the hook members, and reinserting the shaft to retrieve more hair.

Second, Hondo discloses the hook members as being helically configured around the longitudinal axis of the shaft. Such an arrangement is unnecessarily complex and expensive to manufacture.

SUMMARY OF THE INVENTION

With the disadvantage of the above devices in mind, the present invention consists of an elongate, flexible strip with a plurality of barbed portions interspersed along its length, and a handle attached to the flexible strip.

A principle object and advantage of the present invention is that it increases the amount of hair removed from a drain with a single insertion of the shaft because the barbed portions are interspersed along the length of the shaft, rather than being limited to one end of the shaft.

A second principle object and advantage of the present invention is that is simple and expensive to manufacture, in that the barbed portions simply alternate with one another along the strip, rather than being helically configured around the strip.

A third principle object and advantage of the present invention is that it is simple and inexpensive to manufacture because it can be made from a single piece of flexible material, such as plastic.

BRIEF DESCRIPTION OF THE DRAWINGS

FIG. 5 is a perspective view of the present invention being removed from a drain.

DETAILED DESCRIPTION OF THE PREFERRED EMBODIMENT

Figure 1:
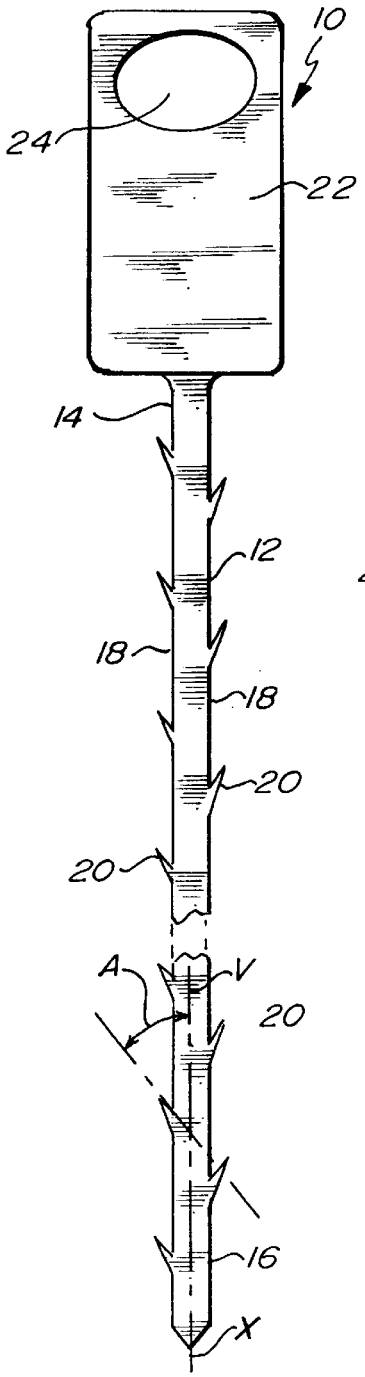
FIG. 1 is a top plan view of the apparatus of the present invention.
Figure 2:
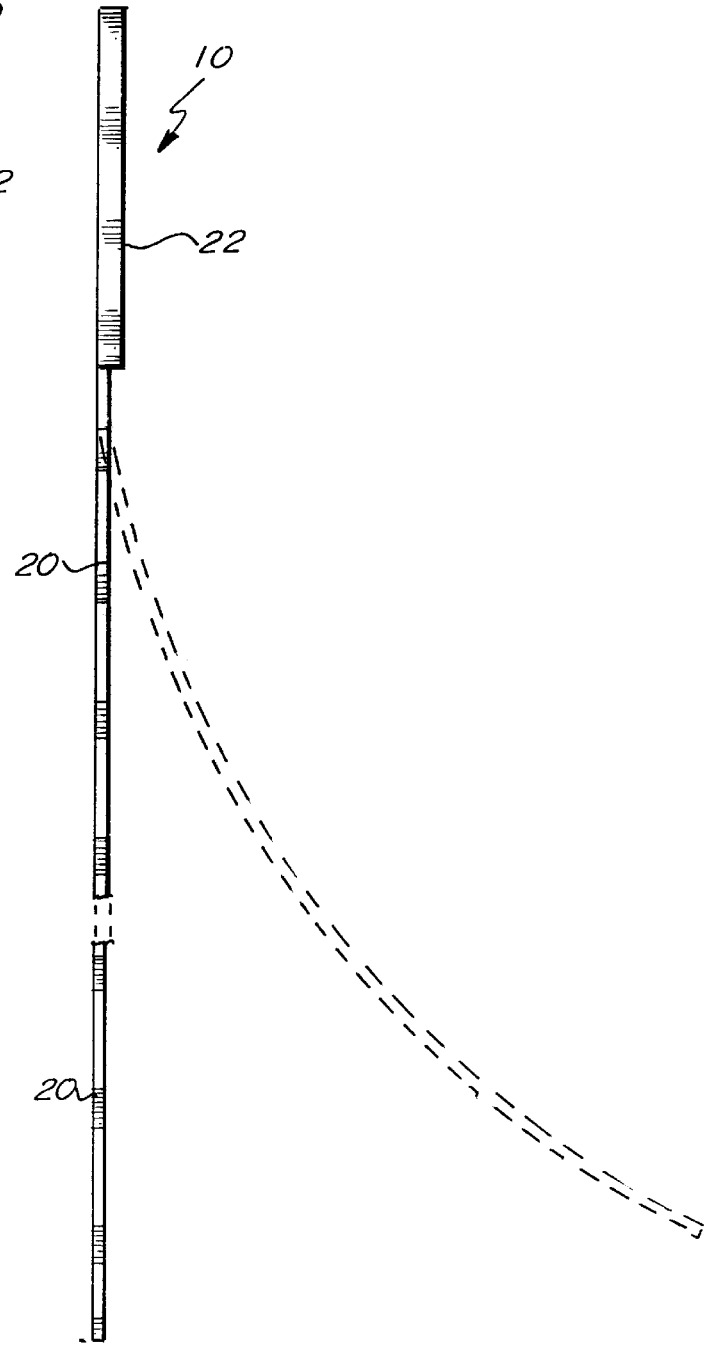
FIG. 2 is a side elevational view of the apparatus of the present invention, with the flexing of the invention shown in phantom.

The apparatus of the present invention is generally shown in the Figures as reference numeral 10.

The apparatus 10 comprises an elongate, flexible strip 12. The strip 12 has a proximal end 14 and a distal end 16. Preferably, the strip 12 is substantially flat, with sides 18.

A plurality of barbed portions 20 are interspersed along the length of the strip 12. The barbed portions are adapted to grip hair in a drain. Preferably, the barbed portions 20 alternate along the sides 18 of the elongate, flexible strip 12.

As best seen in FIG. 1, the barbed portions 20 are preferably oriented at an angle A to the axis X of the strip 12, the angle being acute with the vertex V of the angle pointing away from the proximal end 14.

A handle 22 is attached to the flexible strip 12 at the proximal end 14. Preferably, the handle 22 is integrally molded with the strip 12. The handle may have an aperture 24 therethrough to allow the handle to be gripped by a person's fingers, as best seen in FIGS. 3 and 4.

Figure 3:
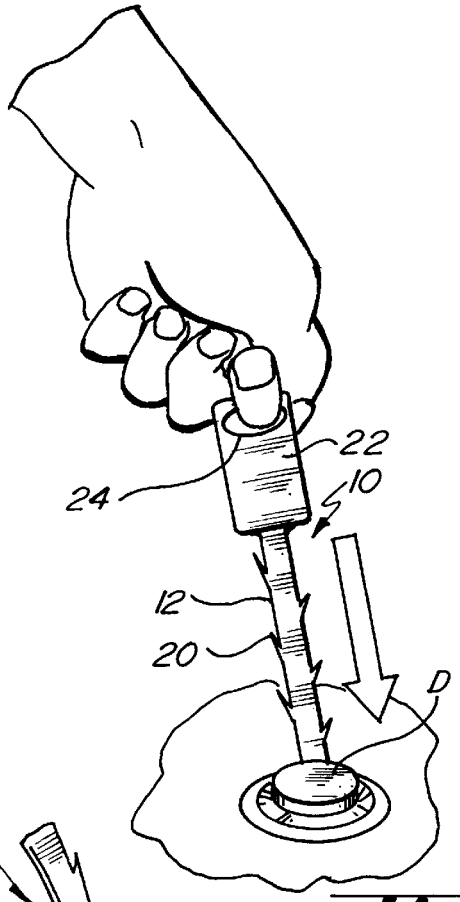
FIG. 3 is a perspective view of the present invention being inserted into a drain.
Figure 6:
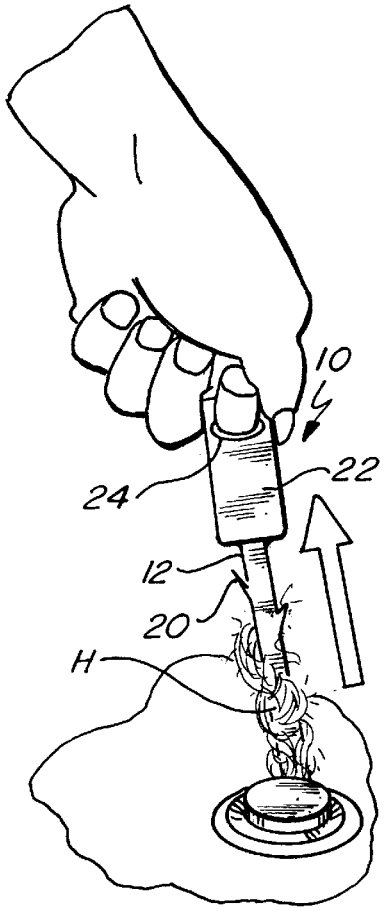
Figure 4:
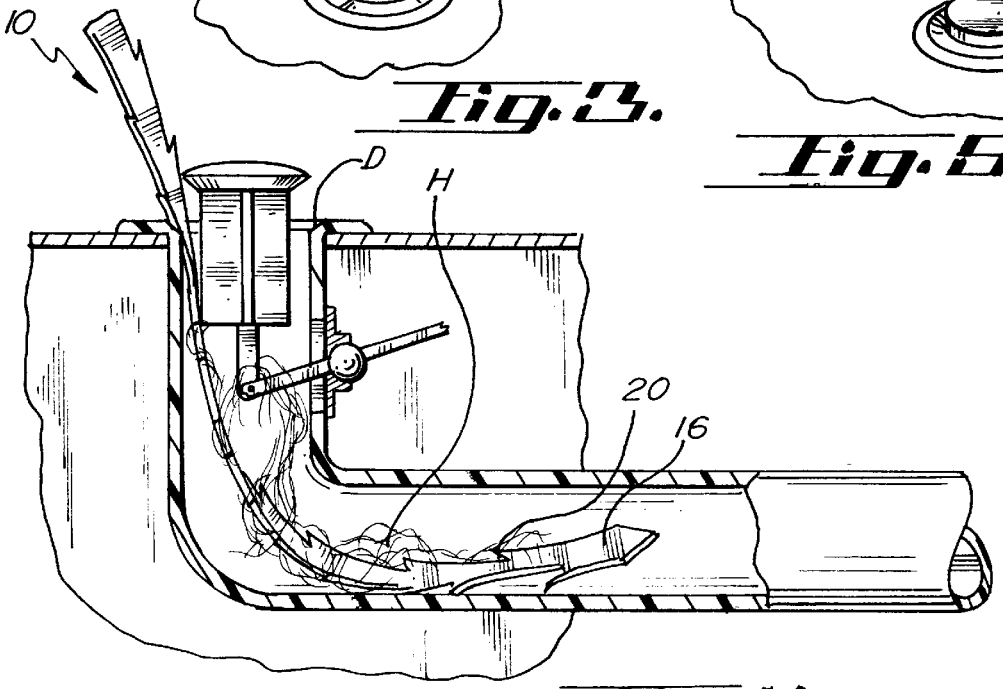
FIG. 4 is a cross section of a drain showing the apparatus in place in the drain.

Operation of the device is shown in FIGS. 3, 4, and 5. Turning to FIG. 3, a person grips the device 10 by its handle 22, preferably by inserting a finger through the aperture 24. The device 10 is then inserted into the drain D, with the distal end 16 leading, as shown by the arrow in FIG. 3.

FIG. 4 shows the device 10 fully inserted into the drain D, with hair H being gripped by the barbed portions 20.

The device 10 is then withdrawn from the drain in the direction as shown by the arrow in FIG. 5, with the gripped hair being removed from the drain.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. Apparatus for removing hair from a drain, comprising:

(a) an elongate, flexible strip;

(b) the elongate, flexible strip having a plurality of barbed portions, the barbed portions being adapted to grip hair in the drain, wherein the barbed portions are oriented at an acute angle to the axis of the elongate strip, wherein the vertex of the angle points away from the handle; and (c) a handle, wherein the handle is a distinct structural element from the elongate, flexible strip.

2. The apparatus of claim 1, wherein the barbed portions are integrally molded with the elongate strip.

3. The apparatus of claim 1, wherein the handle has an aperture therethrough adapted for gripping with a person's fingers.

4. The apparatus of claim 1, wherein the barbed portions alternate along each side of the elongate, flexible strip.

5. The apparatus of claim 1, wherein the handle further comprises a flat, rectangular plate.

6. The apparatus of claim 1, wherein the handle is integrally molded with the elongate, flexible strip.

7. Apparatus for removing hair from a drain, comprising:

(a) an elongate, flexible strip;

(b) a handle; wherein the handle is a distinct structural element from the elongate, flexible strip, and (c) the elongate, flexible strip having a plurality of barbed portions, wherein the barbed portions alternate along each side of the elongate, flexible strip, the barbed portions being adapted to grip hair in the drain, wherein the barbed portions are oriented at an acute angle to the axis of the elongate, flexible strip, and wherein the vertex of the angle points away from the handle.

8. The apparatus of claim 7, wherein the barbed portions are integrally molded with the elongate strip.

9. The apparatus of claim 7, wherein the handle has an aperture therethrough adapted for gripping with a person's fingers.

10. The apparatus of claim 7, wherein the handle further comprises a flat, rectangular plate.

11. The apparatus of claim 7, wherein the handle is integrally molded with the elongate, flexible strip.

12. Apparatus for removing hair from a drain, comprising:

(a) an elongate, flexible strip;

(b) a handle, integrally molded with the elongate, flexible strip, wherein the handle is a distinct structural element from the elongate, flexible strip, the handle having an aperture therethrough adapted to be gripped by a person's fingers;

(c) the elongate, flexible strip having a plurality of integrally molded barbed portions, wherein the barbed portions alternate along each side of the elongate, flexible strip, the barbed portions being adapted to grip hair in a drain, wherein the barbed portions are oriented at an acute angle to the axis of the elongate strip, and wherein the vertex of the angle points away from the handle.

* * * * *